US010337742B2

(12) United States Patent
Holtdirk

(10) Patent No.: US 10,337,742 B2
(45) Date of Patent: Jul. 2, 2019

(54) COOKING APPLIANCE

(71) Applicant: Miele & Cie. KG, Gütersloh (DE)

(72) Inventor: Hans-Gerd Holtdirk, Lippstadt (DE)

(73) Assignee: Miele & Cie. KG, Gütersloh (DE)

( * ) Notice: Subject to any disclaimer, the term of this patent is extended or adjusted under 35 U.S.C. 154(b) by 578 days.

(21) Appl. No.: 15/069,992

(22) Filed: Mar. 15, 2016

(65) Prior Publication Data

US 2016/0273781 A1 Sep. 22, 2016

(30) Foreign Application Priority Data

Mar. 18, 2015 (DE) ..... 10 2015 104 030

(51) Int. Cl.

| | |
|---|---|
| ***F24C 15/36*** | (2006.01) |
| ***F24C 15/34*** | (2006.01) |
| ***F24C 15/02*** | (2006.01) |
| ***F24C 15/04*** | (2006.01) |
| ***F24C 7/08*** | (2006.01) |

(52) U.S. Cl.

CPC ..... *F24C 15/04* (2013.01); *F24C 7/085* (2013.01)

(58) Field of Classification Search

CPC ..... F24C 15/026; F24C 7/087; F24C 15/02; F24C 15/2021; F24C 7/088; H05B 6/76; H05B 6/6414

See application file for complete search history.

(56) References Cited

U.S. PATENT DOCUMENTS

| | | | | |
|---|---|---|---|---|
| 3,700,846 | A | 10/1972 | Ishikawa et al. | |
| 3,715,554 | A * | 2/1973 | Umezu | H05B 6/6417 200/50.05 |
| 2004/0050379 | A1* | 3/2004 | Kuttalek | F24C 7/08 126/1 R |
| 2007/0125760 | A1* | 6/2007 | Kim | F24C 15/006 219/391 |
| 2017/0082297 | A1* | 3/2017 | Ivanovic | F24C 15/006 |

FOREIGN PATENT DOCUMENTS

DE 102 28 141 A1 1/2004

* cited by examiner

*Primary Examiner* — Gregory L Huson
*Assistant Examiner* — Elizabeth M. May
(74) *Attorney, Agent, or Firm* — Brinks Gilson & Lione

(57) ABSTRACT

A cooking appliance (1) includes a cooking chamber (4) heatable by a heating device (3), a cooking chamber opening (5), a cooking chamber door (6) closing off the cooking chamber opening (5), and a control device (7) for controlling the heating device (3). The cooking chamber door (6) has a multi-pane construction having a first pane (8) and a second pane (9). A detector device (10) operatively connected to the control device (7) is actuated by the cooking chamber door (6). In addition, a locking device (11) between the first (8) and the second pane (9) includes a locking element (12), which is held preloaded in an initial state (13) between the first (8) and the second pane (9), and if the first pane (8) is defective, the locking element (12) is automatically displaced to a locking position (14), thereby preventing a complete closure of the cooking chamber door (6).

14 Claims, 3 Drawing Sheets

COOKING APPLIANCE

TECHNICAL FIELD

The present invention relates to a cooking appliance having at least one cooking chamber, which is heatable by means of at least one heating device, with at least one cooking chamber opening. Product to be cooked can be introduced into the cooking chamber via the cooking chamber opening. There is at least one cooking chamber door that closes off the cooking chamber opening and at least one control device for controlling the heating device. Here, the cooking chamber door has a multi-pane construction having at least one first pane and at least one second pane in order to ensure a particularly advantageous thermal isolation of the cooking chamber and a coolest possible outer surface of the door. Furthermore, at least one detector device in operative connection to the control device is provided in the cooking chamber and/or on the cooking chamber door, wherein the detector device is actuated by the cooking chamber door when the cooking chamber door is completely closed, whereby the control device is unblocked.

BACKGROUND

Depending on the operating mode, very high temperatures can prevail in the cooking chambers of cooking appliances. Some cooking appliances also provide, among other things, a cleaning of the cooking chamber via a pyrolysis method. Then, the cooking chamber is heated to 450° C. or even hotter in order to burn contaminants adhering to the cooking chamber walls.

So that hot or excessively hot air cannot escape from the cooking chamber in a cooking process, and in particular also in a pyrolysis process, and in order for the outer side of the cooking chamber door not to exceed a critical temperature, the doors must be adequately insulated.

Sufficient insulation in glass doors, or cooking chamber doors including a viewing window, is achieved via a multi-pane construction. In such a multi-pane construction, a satisfactory insulation is achieved by a plurality of panes disposed parallel to one another and spaced apart from one another, so that no risk arises for a user.

For a satisfactory insulation, it is important that the panes are intact and in particular that the inner pane is not damaged. Thus, a cooking appliance having a cooking chamber door with a multi-pane construction should not be used if a pane is defective.

In order to prevent the operation of a cooking appliance with a broken pane, attempts have been made to minimize the risk of a defective pane. For this purpose, panes made of laminated glass have been used in order to avoid a leak of the inner pane in the event of a defect. By means of a thermostat, it could also be verified via the temperature profile in the cooking chamber whether the panes of the cooking chamber door are intact. To date, a reliable solution could, however, not be found. Thus, under certain circumstances it can happen that a cooking appliance can be operated despite having a defective pane.

SUMMARY OF THE INVENTION

It is therefore the object of the present invention to provide a cooking appliance having a cooking chamber door of a multi-pane construction, which can be operated safely.

This object is achieved by a cooking appliance having the features of claim 1. Preferred further developments of the invention are the subject matter of the dependent claims. Further advantages and features of the invention arise from the exemplary embodiments.

The inventive cooking appliance comprises at least one cooking chamber, which is heatable by means of at least one heating device with at least one cooking chamber opening. Furthermore, the cooking appliance comprises at least one cooking chamber door that closes off the cooking chamber opening, and at least one control device for controlling the heating device. Here, the cooking chamber door has a multi-pane construction, having at least one first and least one second pane. In addition, at least one detector device in operative connection to the control device is provided in the cooking chamber and/or on the cooking chamber door, wherein the detector device is actuated by the cooking chamber door when the cooking chamber door is completely closed. The control device is unblocked on actuation of the detector device by the cooking chamber door. Furthermore, at least one locking device is provided, which is provided between the first and the second pane, wherein the locking device comprises at least one locking element, which is held preloaded in an initial position between the first and the second pane. In the event of a defective pane, the locking element can be automatically displaced to a locking position in order to prevent the complete closure of the cooking chamber door.

According to the invention, the cooking chamber door has a viewing window of a multi-pane construction, or the entire door is provided by a pane pack. Here, the first pane is in particular the inner pane, i.e., the pane that directly seals the cooking chamber opening when the cooking chamber door is closed. Depending on the construction of the door, the second pane is either the outer pane or a middle pane, which is disposed not directly adjacent to the cooking chamber opening, but adjacent to the first pane.

The cooking appliance preferably comprises at least one housing device, wherein the cooking chamber is in particular configured sectionally by the housing device or delimited thereby.

According to the invention, the detector device is provided in the cooking chamber and/or on the cooking chamber door. Here, it is provided in particular that the detector device is received at least sectionally or partially on the housing device of the cooking appliance. Here, at least one component of the detector device is disposed adjacent to or on the cooking chamber, or on the housing device adjacent to the cooking chamber, so that the cooking chamber door actuates the detector device as soon as the cooking chamber door has been or is completely closed.

Here, the detector device comprises in particular at least one switch device or one switch or is provided by a switching device. Such a switching device can, for example, be mechanically configured. Other useful further developments are also preferred, wherein, for example, an optical switch such as a light barrier or other switching devices or detector devices are also used.

According to the invention, a defective first or inner pane is understood in particular to mean that the first pane is completely destroyed or removed. Then, the preloaded locking element is displaced from the initial position to the locking position, whereby the cooking chamber door can no longer be completely closed. Then, the detector device is not actuated by the cooking chamber door, whereby the controller remains blocked. Depending on the configuration, however, the locking element can also be displaced to the locking position if the first pane is only partially defective.

The inventive cooking appliance provides many advantages. One significant advantage is that, due to the specially designed locking device, a mechanical protection for a cooking appliance is provided, by means of which it can be ensured that the cooking appliance is not operated with a defective cooking chamber door. Here, it can be ensured in particular that the cooking appliance is not operated if the first pane or the inner pane of the cooking chamber door is defective or no longer present.

This is advantageous in particular if the cooking appliance is equipped with a pyrolysis function. During the cleaning of the cooking chamber by means of the pyrolysis function, the cooking chamber is usually heated to temperatures of approx. 450° or more. Precisely at such high temperatures it is necessary that the cooking chamber door has no defect, and in particular that the cooking chamber door has a functional first or inner pane. Only then is sufficient thermal sealing of the cooking chamber ensured.

Since the locking device is mechanically configured, a particularly reliable safety system is provided, by means of which the operation of the cooking appliance with a defective cooking chamber door is prevented.

By means of such a detector device the control device is unlocked, if it is actuated by the cooking chamber door. Here, according to the invention, the detector device is first actuated when the cooking chamber door is completely closed. If the cooking chamber door is not completely closed, the detector device is also not actuated, whereby the control device is not unblocked and the heating device can thereby not be activated, or whereby the control device only operates the heating device with a limited output. Thus, it is possible, for example, that a normal cooking process can still be carried out, but a pyrolysis function is blocked.

In the case of a defective first pane, the locking element preferably hits against at least one section of a housing device when the cooking chamber door is closed. Here, the locking device or the locking element is in particular received on the cooking chamber door such that it hits against a section of the housing device adjacent to the cooking chamber opening in the locking position so that the door cannot be completely closed. It is thus effectively achieved that the detector device is not actuated by the cooking chamber door in the case of a defective first pane, whereby the control device remains blocked.

Particularly preferably, the locking device comprises at least one preloading device. And a preloading device is in particular understood to be a tension spring, a pressure spring, or another spring element, with which the locking element is held preloaded between the first and the second pane. Due to the preloading device, the locking element is automatically transferred from the initial position to the locking position in the case of a defective first pane.

In preferred designs, the locking element is pivotably received on the holding device. Here, pivotable is to be understood in particular as rotatable or foldable or tippable, so that the locking element can be transferred from the initial position to the locking position via a rotating movement and/or a folding or tipping movement.

In advantageous further developments, the locking element is held in the initial position essentially parallel to the first and/or the second pane, wherein, in the case of a defective first pane, the locking element is at an angle to the first and/or the second pane in the locking position. Such a design is advantageous in particular in a locking element designed to be foldable. In the case of a defective first pane, such a locking element folds downward, for example, so that the locking element is at an angle to the first and/or the second pane. Here, an angle is preferred in particular that prevents the complete closure of the cooking chamber door in connection with a certain length of the locking element. The angle is advantageously approximately 90° to the initial position of the locking element.

The locking element is preferably displaceably received on the holding element. In such a design, the locking element can preferentially be configured as a spring-loaded pin, which is held preloaded in an initial position between the first and the second pane. In the case of a defect of the first pane, the pin, or the locking element, is preferentially pushed out by the preloading device from the initial position into the locking position, whereby a complete closure of the cooking chamber door is prevented.

Particularly preferably the locking element then is at an angle to the first and/or second pane in the initial position, wherein, in the case of a defective pane, the locking element extends to the locking position in the axial direction. Also here the length of the locking element is preferentially designed such that the complete closure of the cooking chamber door is prevented by the extended locking element.

In expedient further developments, the locking device comprises at least one securing device. By means of such a securing device, it can be ensured that the locking element is fixed or locked in the locking position as soon as the locking element is displaced from the initial position to the locking position by a defect in the first pane.

Preferentially, the locking device is received on the second pane. Here, the locking device or the holding device of the locking device can in particular be adhered to the second pane by means of a suitable adhesive. Other appropriate attachment methods can be useful depending on the embodiment.

The cooking chamber door preferably comprises at least one spar device, wherein the locking device is received on the spar device. A simple attachment of the locking device to the cooking chamber door can also be achieved with such an embodiment.

In advantageous further developments the detector device comprises at least one pressure switch. The control device can be unblocked in a simple manner via a pressure switch as soon as the cooking chamber door is completely closed. Then, in the completely closed state, the cooking chamber door presses against the pressure switch, whereby the pressure switch is activated or actuated and thus unblocks the control device. Other switches and/or detector mechanisms can also be used in other embodiments in order to unblock the control device when the cooking chamber door is completely closed.

The detector device preferably comprises at least one first and at least one second detector element, wherein the first detector element is associated with the cooking chamber door and wherein the second detector element is associated with the cooking chamber or the housing device of the cooking appliance or vice versa. Thus, the detector device, or also the switching device, can be configured in two parts, wherein a component of the switching device is respectively provided both on the cooking chamber door and on the cooking chamber or on a housing section surrounding the cooking chamber. Thus, for example, a pressing element can be provided on the cooking chamber door, which actuates a pressure switch adjacent to the cooking chamber as soon as the cooking chamber door is completely closed.

Particularly preferably the cooking chamber door comprises at least one third pane, wherein the third pane then in particular provides an outer pane of the cooking chamber door. Here, the third pane is provided adjacent to the second pane, wherein the locking device is furthermore held preloaded between the first and the second pane.

Further advantages and features of the present invention arise from the exemplary embodiments, which will be explained below with reference to the accompanying drawings. The drawings are provided purely for illustrative purposes and are not intended to limit the scope of the present invention.

DETAILED DESCRIPTION OF THE DRAWINGS

Figure 1:
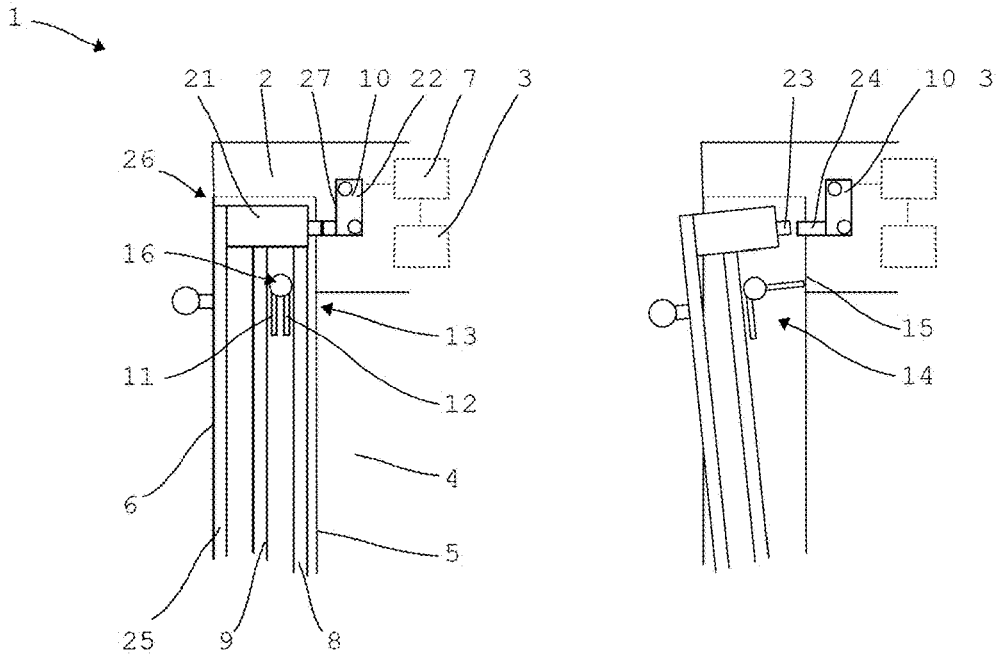
FIG. 1 shows a purely schematic depiction of an inventive cooking appliance in two lateral cross-sectional views.

In FIG. 1 an inventive cooking appliance 1 is shown purely schematically in a lateral cross-sectional view in the region of the cooking chamber opening 5. Here, the left depiction shows the cooking chamber door 6 in a closed position, and the right depiction shows the cooking chamber door 6 in a slightly open position.

In the exemplary embodiment shown here, the inventive cooking appliance 1 comprises a housing device 2, wherein or whereon a cooking chamber 4 is provided. The cooking chamber 4 can be heated by means of at least one heating device 3, wherein, for example here, a top and bottom heating operation, an air-circulation operation, a hot-air operation, a grill operation, and/or also a gas operation can be made possible by the heating device 4. The mode of operation and/or the output of the heating device 3 can be set or regulated via a control device 7.

The shown cooking appliance 1 additionally has a pyrolysis function, via which pyrolysis function dirt adhesions on the cooking chamber walls can be converted into carbon, so that only the remaining residual dirt needs to be wiped away with a damp cloth after completion of the pyrolysis.

For the loading of the cooking chamber 4, the cooking chamber 4 comprises a cooking chamber opening 5, which can be closed off by a cooking chamber door 6. So that the cooking appliance 1 is not operated, or so that the heating device 3 cannot be operated with excessive power output when the cooking chamber door 6 is not completely closed, the cooking appliance shown here comprises a safety mechanism 26, via which it is ensured that the cooking appliance 1 is not operated, or is not operated at full power output when the cooking chamber door is not completely closed.

Here, the safety mechanism 26 comprises a detector device 10, via which it is determined whether the cooking chamber door 6 is completely closed on the housing device 2, or abuts on the cooking chamber opening 5.

In the exemplary embodiment shown here, the detector device 10 is configured as a switching device 27 and specifically as a pressure switch 22. Here, the pressure switch 22 is pressed-in by the cooking chamber door 6 in the completely closed state, so that it is activated and unblocks the control device 7.

In the exemplary embodiment shown here, the detector device comprises a first detector element 23, which is associated with the cooking chamber door 6, and a second detector element 24, which is associated with the housing device 2 or with the cooking chamber opening 5 or with the cooking chamber 4. Due to the detector device 10, it is ensured that the control device 7 is or has only been unblocked when the cooking chamber door 6 is completely closed. It can thus be achieved that, if the cooking chamber door 6 is not completely closed, the control device 7 does not unblock the heating device 3 or does not unblock the heating device 3 at full power output.

In the exemplary embodiment shown here, the cooking chamber door 6 closing off the cooking chamber opening 5 has a multi-pane construction that has three panes 8 and 9, and 25. Here, if the cooking chamber door 6 is closed, the first pane 8 covers the cooking chamber opening 5. Thus, the first pane 8 provides the inner pane 8 of the cooking chamber door 6.

A second pane 9, or a middle pane 9 and a third pane 25 or an outer pane 25 are provided parallel to the first pane 8. By means of such a multi-pane construction, a particularly good thermal insulation of the cooking chamber 4 is provided, wherein a thermally well insulated pane is also particularly necessary with a pyrolysis operation. Due to the multi-pane construction, it is then achieved that the outer pane does not exceed a critical temperature, so that no risk of injury arises during operation of the cooking appliance 1.

In order that an optimal cooling effect or insulating effect of the cooking chamber door 6 is ensured, it is necessary that in particular the first pane 8 is intact. In order to prevent the operation of the cooking appliance with a defective or even completely absent first or inner pane 8, a locking device 11 is provided in the exemplary embodiment shown here, which comprises a locking element 12. Here, the locking element 12 is received preloaded between the first pane 8 and the second pane 9.

In such a position of the locking element 12, it is in the initial position 13. In the case of a defective or absent first pane 8, the preloaded locking element 12 is automatically displaced to a locking position 14, whereby the locking element 12 hits against a section 15 of the housing device 2 adjacent to the cooking chamber opening 5 when the cooking chamber door 6 is closed. It is thereby prevented that the cooking chamber door 6 is completely closed, whereby otherwise the detector device 10 would be triggered. Since the locking element 12 prevents the complete closure of the cooking chamber door, unblocking of the control device 7 with a missing or defective first or inner pane 8 is effectively prevented. It can thus be prevented that the cooking appliance 1 can be operated or operated at full power output with a defective or absent first pane 8.

Figure 2:
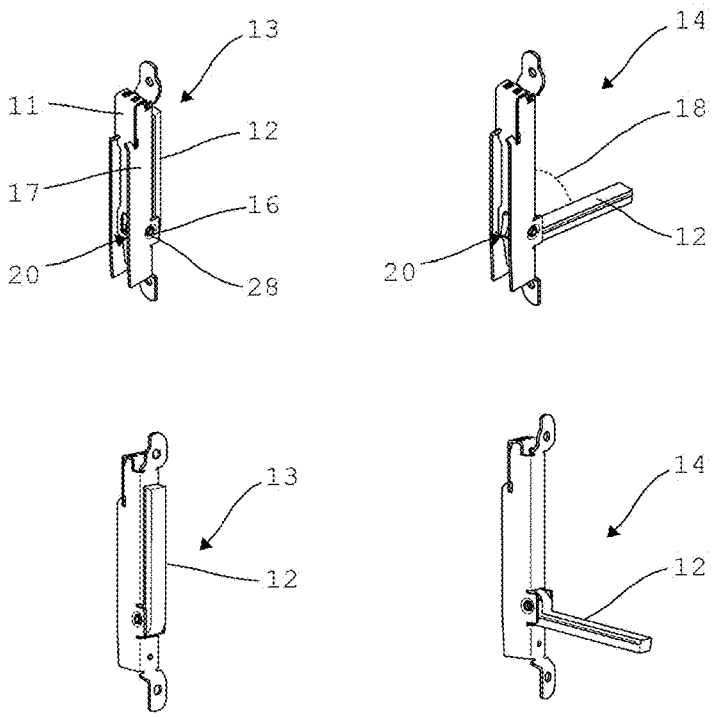
FIG. 2 shows a purely schematic depiction of an exemplary embodiment of a locking device in four perspective views.

In FIG. 2, an exemplary embodiment of a locking device 11 is perspectively depicted purely schematically in four different views. In the exemplary embodiment shown here, the locking device 11 comprises a holding device 17, by means of which the locking device 11 can be received on the cooking chamber door 6. In such an embodiment, it is convenient that the holding device 17 is attached, for example, on the second pane 9. For this purpose, the holding device 17 or the locking device 11 can be adhered to the second pane 9 by means of a suitable temperature resistant adhesive.

In the initial position, the locking element 12 abuts on the holding device 17. In the installation situation, the locking element 12 is then held preloaded essentially parallel to the first or to the second pane 8 and 9. The preloading is achieved by a preloading device 16, which is provided in this case by a spring element 28. Such a spring element 28 can be realized, for example, by a pressure spring or a tension spring.

In the case of a defective or missing first pane, the spring element 12 is automatically displaced by the preloading to the locking position 14. Here, this is effected by a rotational movement of the locking element 12, which in this case is rotatably, tiltably, or pivotably received on the holding device 17.

In the locking position 14, the locking element 12 is at an angle 18 to the holding device 17 and thus also at an angle to the first or to the second pane 8 and 9. Here, an angle of, in particular, approx. 90° is advantageous. Generally, it is advantageous if by choosing the length of the locking element 12 and by choosing the angle 18 of the locking element 12 in the locking position 14, it is achieved that the cooking chamber door 6 cannot be completely closed.

Furthermore, in the shown exemplary embodiment, a securing device 20 is provided that prevents the locking element 12 from being inadvertently displaced from the locking position 14 back again to the initial position 13. For example, such a securing device can be provided by a latching device not depicted in more detail, which holds the locking element 12 in the locking position 14 by a latching effect.

Figure 3:
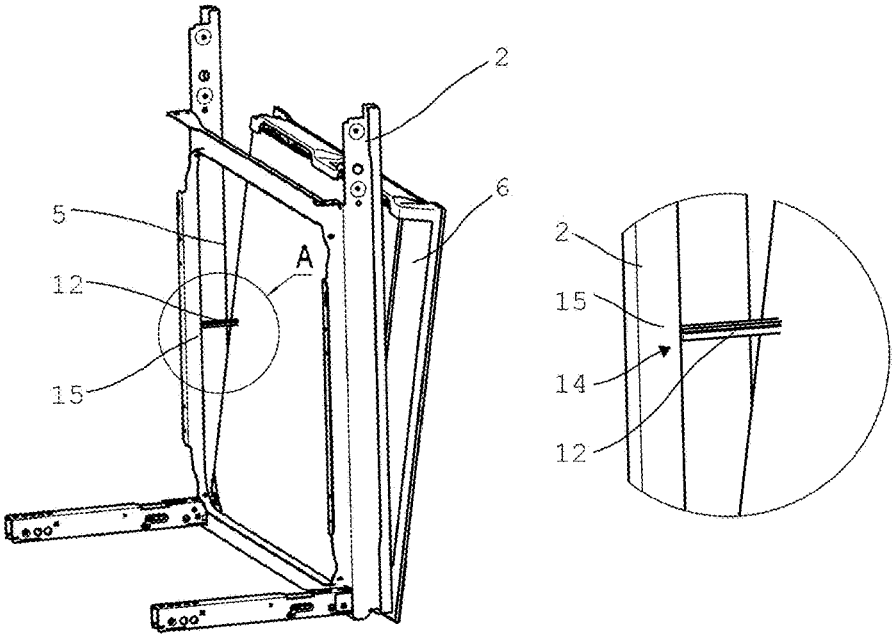
FIG. 3 shows a purely schematic depiction of the cooking chamber door and of the cooking chamber opening of an inventive cooking appliance in a perspective view.
Figure 4:
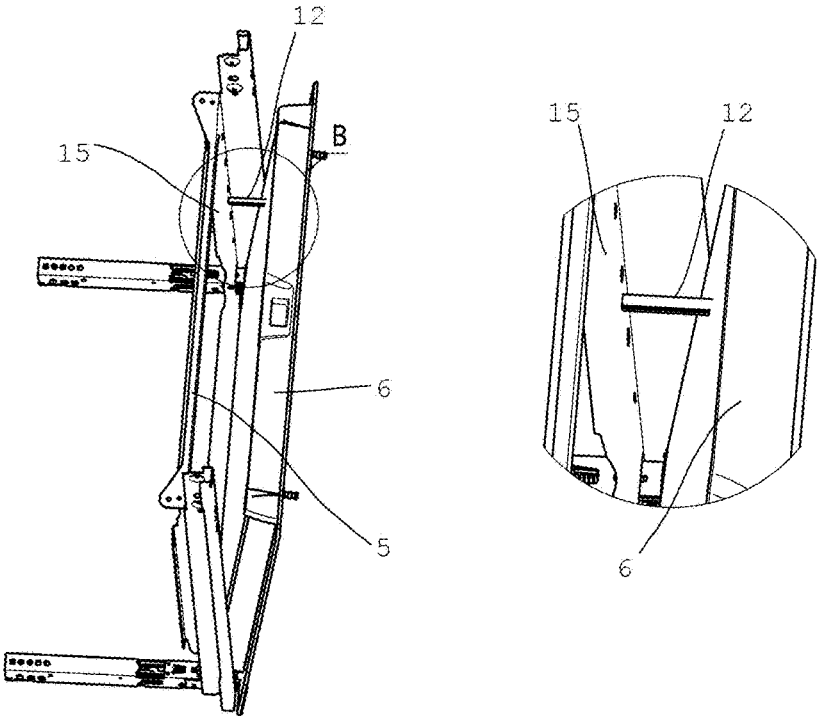
FIG. 4 shows the depiction according to FIG. 3 in another perspective view.

In FIGS. 3 and 4, the previously described locking device 11 is depicted in the installation situation in a cooking chamber door 6 in two different perspective views.

In both Figures the locking element 12 is in the locking position 14 due to a defect of the first pane 8, wherein it can in particular be seen in the two detailed enlargements of the Figure that the locking element 12 rests against a section 15 of the housing device 2 adjacent to the cooking chamber opening 5.

It is thereby achieved that the cooking chamber door 6 cannot be completely closed, whereby the detector device 10 is also not triggered or not actuated. Thus, a mechanical protection is provided that prevents the closure of the cooking chamber door 6 if the first pane 8 is defective or no longer present. It can thus be very reliably ensured that the cooking appliance 1 is not operated or, depending on the design of the control device 7, not operated at full power output, if the first pane 8 is defective or no longer present.

Figure 5:
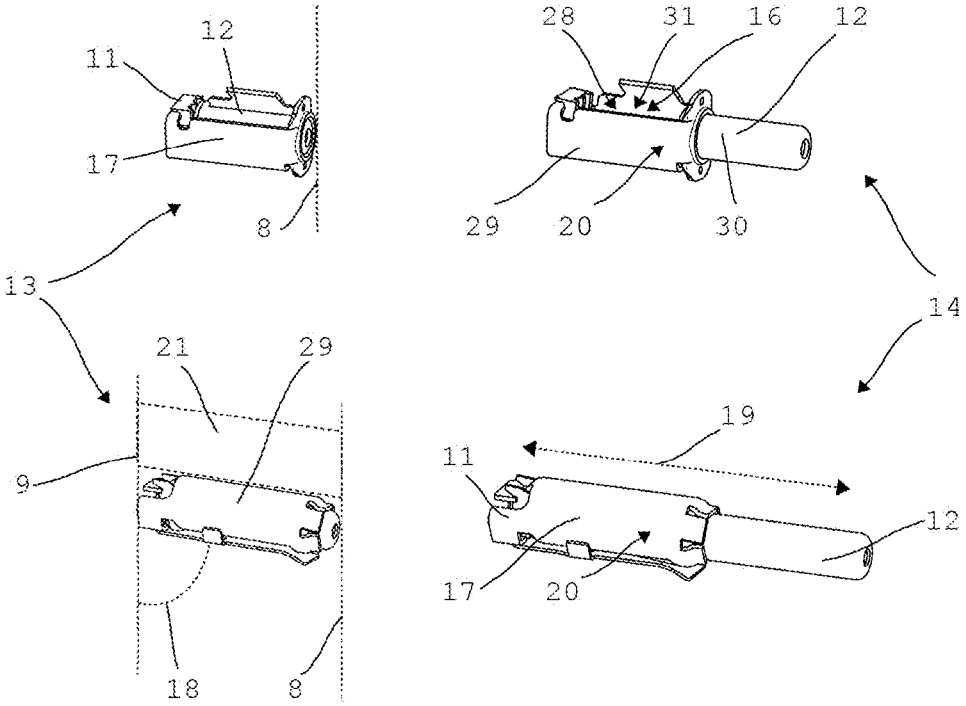
FIG. 5 shows two further purely schematically depicted exemplary embodiments of locking devices in perspective views.

In FIG. 5, two further exemplary embodiments of advantageous locking devices 11 are purely schematically depicted. In the installed state, the locking devices 11 shown here or the locking elements 12 of the locking device 11 are disposed at an angle 18 to the first or to the second pane 8 and 9.

Here, the locking devices 11 each have a holding device 17, which, in the exemplary embodiments shown here, is configured essentially as sleeve-type or as a sleeve 29. The locking element 12 is received in the sleeve 29, which locking element 12 is configured pin-type in the exemplary embodiment shown here.

In the shown exemplary embodiment, the locking device is received on a spar device 21 of the cooking chamber door 6. Here, the spar device 21 provides a frame structure of the cooking chamber door 6 on which the panes 8 and 9, and 25 are received.

In the case of an intact first pane 8, the pin 30 is at least sectionally pushed into the sleeve 29. Here, the pin 30, or the locking element 12 in this initial position 13 is held preloaded by a preloading device 16. In the exemplary embodiment shown here, the preloading device is provided by a spring element 28 and specifically by a pressure spring 31. In the case of a defect of the first pane 8, or if the first pane 8 is completely removed, the locking element 12 is pushed out in the axial direction 19 by the spring force of the preloading device 16. It is thereby also achieved that the locking element 12 protrudes such that a complete closure of the cooking chamber door 6 is no longer possible. This is achieved by the pin 30 or the locking element 12 resting against a section of the housing device 2 adjacent to the cooking chamber opening 5. In the locking position 14 of the locking element 12, the detector device 10 is not actuated or activated, so that the control device 7 is not unblocked.

In order that the locking element 12 is not pressed back into the holding device 17, and thus into the initial position 13, by strongly pushing the cooking chamber door 6 shut, a securing device 20 is provided in the exemplary embodiment shown here, which, for example, snaps in as soon as the locking element 12 is in the locking position 14. Thus, the locking element 12 is secured in the locking position 14 such that an inadvertent transfer of the locking element 12 to the initial position 13 is prevented.

While the above description constitutes the preferred embodiments of the present invention, it will be appreciated that the invention is susceptible to modification, variation and change without departing from the proper scope and fair meaning of the accompanying claims.

What is claimed is:

1. A cooking appliance (1) comprising a heating device (3), a cooking chamber (4) having a cooking chamber opening (5) and heatable by the heating device (3), a control device (7) for controlling the heating device (3), and a cooking chamber door (6) closing off the cooking chamber opening (5), the cooking chamber door (6) having a multi-pane construction with a first pane (8) and a second pane (9), a detector device (10) in operative connection to the control device (7), the detector device disposed in the cooking chamber (4) or on the cooking chamber door (6), the detector device (10) being actuated by the cooking chamber door (6) when the cooking chamber door (6) is completely closed, and unblocks the control device, and a locking device (11) between the first (8) and the second (9) pane, the locking device (11) including a locking element (12) held preloaded in an initial position (13) completely between the first (8) and the second pane (9), wherein the locking element (12) is configured to be automatically displaced to a locking position (14) in the event of a defective first pane (8) and to prevent a complete closure of the cooking chamber door (6).

2. The cooking appliance (1) according to claim 1, wherein in the case of a defective first pane (8), the locking element (12) hits against a section (15) of a housing device (2) when the cooking chamber door (6) is closed.

3. The cooking appliance (1) according to claim 1, wherein the locking device (11) comprises a preloading device (16).

4. The cooking appliance (1) according to claim 1, wherein the locking device (11) comprises a holding device (17), on which the locking element (12) is movably received.

5. The cooking appliance (1) according to claim 1, wherein the locking device (12) comprises a securing device (20).

6. The cooking appliance (1) according to claim 1, wherein the locking device (11) is received on the second pane (9).

7. The cooking appliance (1) according to claim 1, wherein the cooking chamber door (6) comprises a spar device (21), and in that the locking device (11) is received on the spar device (21).

8. The cooking appliance (1) according to claim 1, wherein the detector device (10) comprises a pressure switch (22).

9. The cooking appliance (1) according to claim 1, wherein the detector device (10) comprises a first detector element (23) and a second detector element (24) cooperating with the first detector element (23), wherein the first detector element (23) is attached to the cooking chamber door (6), and wherein the second detector element (24) is attached to the cooking chamber (4).

10. The cooking appliance (1) according to claim 1, wherein the cooking chamber door (6) comprises a third pane (25).

11. A cooking appliance (1) comprising a heating device (3), a cooking chamber (4) having a cooking chamber opening (5) and heatable by the heating device (3), a control device (7) for controlling the heating device (3), and a cooking chamber door (6) closing off the cooking chamber opening (5), the cooking chamber door (6) having a multi-pane construction with a first pane (8) and a second pane (9), a detector device (10) in operative connection to the control device (7), the detector device disposed in the cooking chamber (4) or on the cooking chamber door (6), the detector device (10) being actuated by the cooking chamber door (6) when the cooking chamber door (6) is completely closed, and unblocks the control device, and a locking device (11) between the first (8) and the second (9) pane, the locking device (11) including a locking element (12) held preloaded in an initial position (13) between the first (8) and the second pane (9), wherein the locking element (12) is configured to be automatically displaced to a locking position (14) in the event of a defective first pane (8) and to prevent a complete closure of the cooking chamber door (6), wherein the locking element (12) is held in the initial position (13) generally parallel to at least one of the first (8) and the second (9) panes, and in that, in the event of the defective first pane (8), the locking element (12) is at an angle (18) to the at least one of the first (8) and the second (9) panes.

12. The cooking appliance (1) according to claim 11, wherein the locking element (12) is pivotably received on the holding device (17).

13. The cooking appliance (1) according to claim 11, wherein the locking element (12) is displaceably received on the holding device (17).

14. The cooking appliance (1) according to claim 13, wherein in the initial position (13) the locking element (12) has a longitudinal axis positioned at an angle (18) to the first (8) or the second pane (9), and in that, in the event of the defective first pane (8), the locking element (12) expands in the axial direction (19) into the locking position (14).

* * * * *